US005093931A

United States Patent [19]

LaBerge et al.

[11] Patent Number: 5,093,931

[45] Date of Patent: Mar. 10, 1992

[54] PROTECTIVE EQUIPMENT HAVING A REBOUND CONTROLLING INSERT

[75] Inventors: Raymond LaBerge, St-Luc; Robert Beauregard, L'Acapie, both of Canada

[73] Assignee: Sport Maska Inc., St. Hyacinthe, Canada

[21] Appl. No.: 382,522

[22] Filed: Jul. 20, 1989

[51] Int. Cl.[5] ..... A41D 13/00; A63B 71/12

[52] U.S. Cl. ..... 2/2; 2/22; 2/267; 273/57.2

[58] Field of Search ..... 2/2, 2.5, 22, 24, 23, 2/267, 268, 269, 92; 273/1 B

[56] References Cited

U.S. PATENT DOCUMENTS

| | | | |
|---|---|---|---|
| 3,135,961 | 6/1964 | Roderick | 2/267 |
| 3,670,339 | 6/1972 | Cooper et al. | 2/22 |
| 3,784,985 | 1/1974 | Conroy | 2/22 |
| 3,854,228 | 12/1974 | Conroy | 36/71 |
| 3,945,042 | 3/1976 | Lobo | 2/2 |
| 4,512,037 | 4/1985 | Vacanti | 2/2 |
| 4,847,913 | 7/1989 | Chen | 2/2 |
| 4,868,926 | 9/1989 | Lowson | 2/22 |
| 4,888,826 | 12/1989 | Parsons, Jr. et al. | 2/22 |

FOREIGN PATENT DOCUMENTS

| | | | |
|---|---|---|---|
| 246812 | 11/1987 | European Pat. Off. | 2/2 |
| 2028141 | 1/1972 | Fed. Rep. of Germany | 2/22 |
| 2322636 | 11/1973 | Fed. Rep. of Germany . | |
| 3283656 | 11/1988 | Japan | 2/2 |
| 263971 | 4/1961 | Netherlands | 2/2 |
| 1556357 | 11/1979 | United Kingdom | 2/22 |

*Primary Examiner*—Stuart S. Levy
*Assistant Examiner*—Joseph A. Rhoa
*Attorney, Agent, or Firm*—Fleit, Jacobson, Cohn, Price, Holman & Stern

[57] ABSTRACT

An improved synthetic pad is used in sports equipment in a three-tiered system. A front visible layer, called a cosmetic component layer, is made to the taste and color of a player or a team. A second component is a backing pad layer. The third and novel component of the present invention is a foam insert layer of about one inch thickness. A pocket provided on the rear of the cosmetic component layer or on the front of the backing pad layer may be provided for receipt of the foam insert layer. The foam insert layer is made and structured in such a way that it provides a choice of rebound possibilities for a player. The foam insert layer may be homogeneous, or lacerated on one side to a depth of about ½ inch in a predetermined pattern. The laceration may be performed by either a blade or with a hot wire or with a thermosetting foam molded to its final shape. The lacerated surface of the foam insert layer may then be submitted to a temperature which will cause it to shrink and harden so as to provide a vee-shaped gap tapering inwardly from the exterior of the foam insert layer to a central portion of the foam insert layer. By the size of the geometric pattern produced in the foam layer, the rebound distance of an object off of the protective equipment is controlled.

23 Claims, 4 Drawing Sheets

FIG. 7
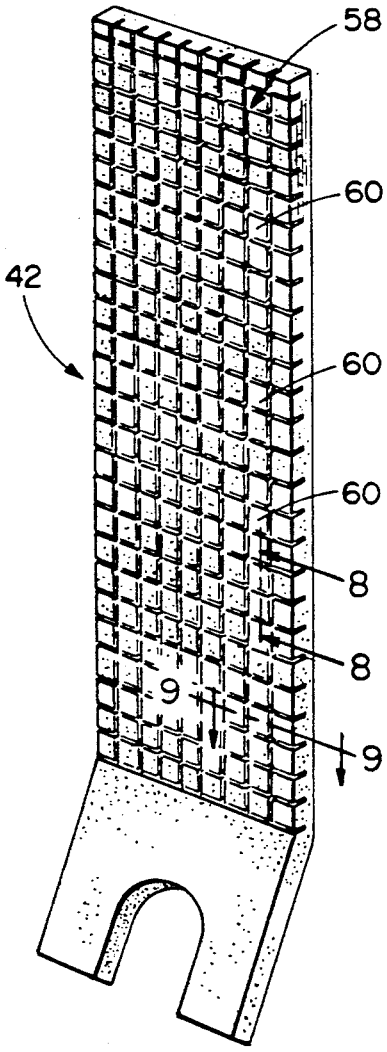
FIG. 10
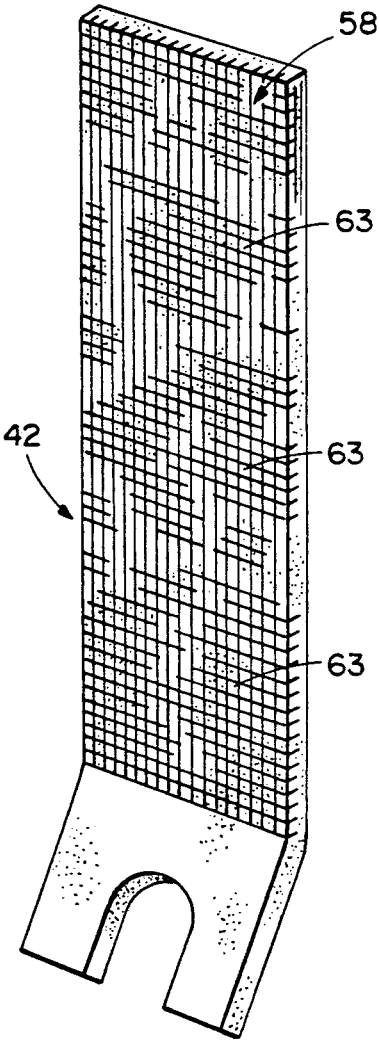
FIG. 11
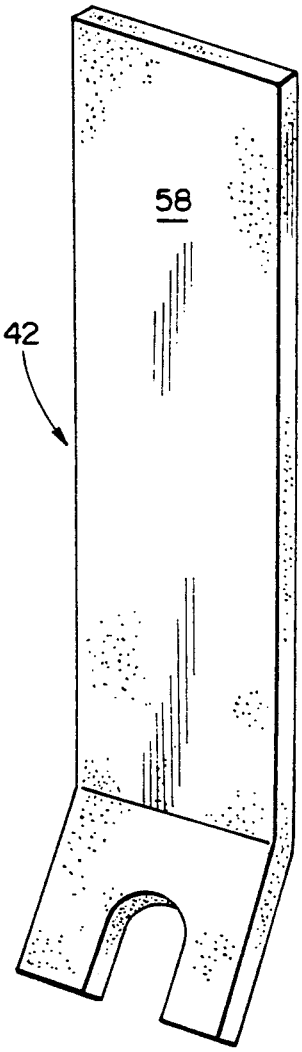
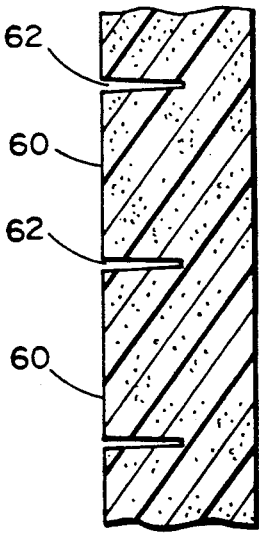
FIG. 8
FIG. 9
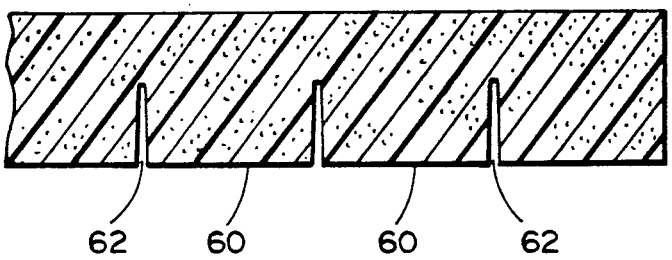

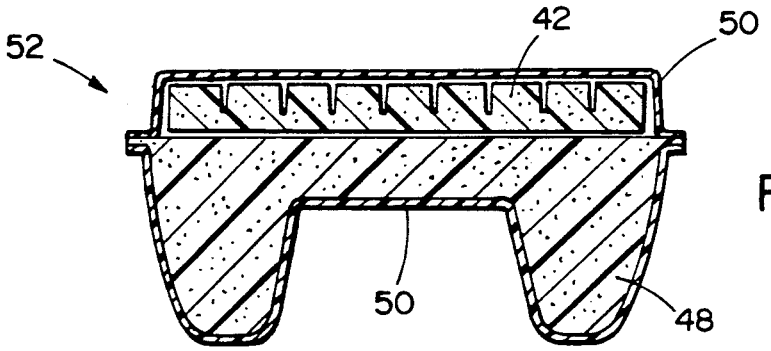
FIG. 12
FIG. 13
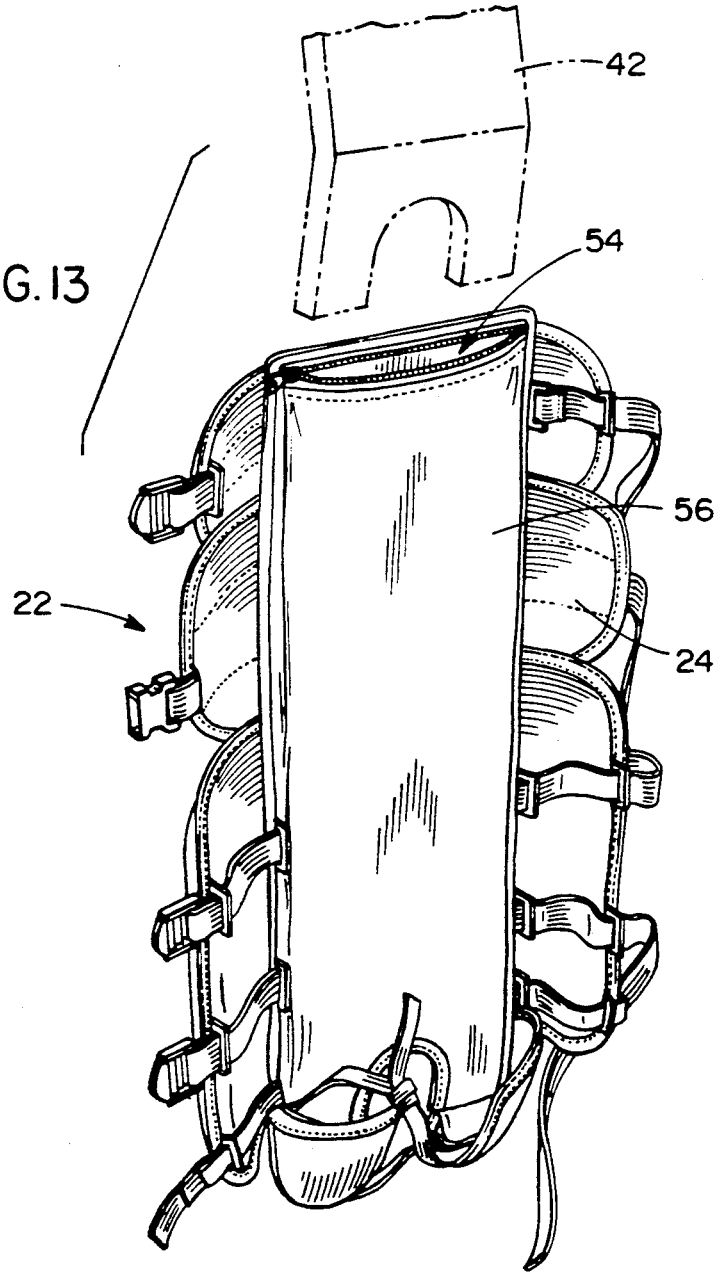

PROTECTIVE EQUIPMENT HAVING A REBOUND CONTROLLING INSERT

FIELD OF THE INVENTION

This invention relates to padded protective equipment which includes a foam layer insert for controlling the amount of rebound of an object off of the protective equipment.

BACKGROUND OF THE INVENTION

In known protective equipment, such as goalie pads used for hockey, the goalie pads are made of leather and other fabric and are stuffed with deer hair which is known to provide a small amount of rebound when a hockey puck hits the goalie pad. This is a very costly and lengthy process to make and the finished pads are quite heavy for the goalie. A goalie pad made of deer hair may weigh up to 8 or 9 pounds.

As an alternative to deer hair pads, synthetic pads, such as one marketed under the name AEROFLEX, includes a series of horizontally extending foam layers of closed-cell polyethylene of about ¼ inch thick which are glued one to the other so as to form a vertically extending pad comprised of a series of horizontally extending layers. The series of horizontally extending foam layers are capable of absorbing much more shock than a simple homogeneous layer of foam. Other synthetic pads have been marketed using homogeneous pieces of foam, either open- or closed-cell foam of thermoplastic or thermoset material where the direct physical properties of the material will determine the characteristics of the pads. Such a pad is marketed under the tradename D&R LASER. However, it has been found that open-cell foam material such as polyurethane, will absorb humidity and freeze when used for hockey equipment.

SUMMARY OF THE INVENTION

By the present invention, an improved synthetic pad is used, for hockey, in a three-tiered system. It is envisioned that the inventive pad may be used in other fields and equipment for improved protection as well as for a control of the amount of rebound from the protective equipment which can be expected by the player wearing the equipment. In addition to goalie pads, goalie hockey glove pads, goalie chest protective equipment, a baseball catcher chest pad and other protective equipment for different sports may incorporate the novel features of the present invention.

With reference to goalie leg pads for hockey players, as an illustrative example, the present invention will be further explained. The invention includes a front visible layer, called a cosmetic component layer, which is made to the taste and color of a player or a team. The cosmetic component layer includes a central portion of approximately ¼ inch thick made of a very thin, high-density foam which contributes to the absorption of shock. The remaining components including two vertical lateral bands, a central and two side knee pads and extended lateral pads are made of one inch thick foam having a density of 4.4 pounds per cubic foot (pcf). A second component is an interior backing pad having a deep channel for receipt of the leg of the hockey player. This pad, made of closed-cell foam, is a soft, thick pad and is very flexible. The pad bends easily to conform to the shape of any leg size or position of a player. A fabric sack surrounds the backing pad so as to include buckles for aiding in securing the backing pad to the front cosmetic component layer. It is known to include the entire backing pad in a zippered sack so as to replace a worn backing pad, if necessary.

The third and novel component of the present invention is a foam insert layer of about one inch thickness. A pocket provided on the rear of the cosmetic component layer or on the front of the backing pad may be provided for receipt of the foam insert layer. The foam insert layer is made and structured in such a way that it provides a choice of rebound possibilities for a player.

For example, certain goalies prefer to have large or long rebounds of a hockey puck off of their protective equipment, while other goalies prefer as little rebound as possible. By the present invention, the goalie is provided with a choice of rebound characteristics of objects off of their protective equipment, and even allows the possibility of changing the amount of rebound off of their protective equipment from one period to another by changing of the foam insert layer.

The foam insert layer may be homogeneous, or lacerated on one side to a depth of about ½ inch in a predetermined pattern. The laceration may be performed by either a blade or with a hot wire when applicable. The lacerated surface of the foam insert layer may then be submitted to a temperature which will cause it to shrink and harden so as to provide a vee-shaped gap tapering inwardly from the exterior of the foam insert layer to a central portion of the foam insert layer. The incisions may be provided in a geometrical pattern such as square, hexagonal, circular, triangular, etc. configuration. By the size of the geometric pattern produced in the foam layer, the rebound distance of an object off of the protective equipment is controlled.

In an alternate embodiment, the foam insert layer may be made integral with the interior backing pad which is of a different type of foam, density, and configuration than the foam insert layer.

Some examples of foam suitable for use as the foam insert layer of the invention are closed-cell foams of thermoplastic or thermoset families, such as LD and HD polyethylene, vinyl nitrile, ethylene vinyl acetate (EVA) and styrene-butadiene rubber (SBR). The choice of material for the foam layer is dependent upon the K factor, density, compression resistance, fatigue resistance, ease of cutting and in the case of thermoplastic foam, the heat molding characteristics.

The density of the foam insert layer is from 1 to 10 pcf, and preferably has a density of 2 to 4 pcf. The higher the density, the more weight which will be added to the protective equipment and thereby minimize the advantage of the overall weight reduction of the invention as compared to deer hair stuffed pads. A preferred LD polyethylene cross-linked foam insert layer is available under the tradename PLASTAZOTE, available from BXL Plastics Limited of Surrey, England.

The preferred foam layer is a polyethylene foam having a density of 2.8 pcf, a K factor of 0.25, a thickness of one inch and cavities ½ inch deep in a configuration of ½×½ inch squares, made by slitting one side of the foam layer in crossing perpendicular cuts ½ inch deep and ½ inch apart in both directions. The slit side of the foam insert layer faces the cosmetic component layer. The slit surface of the foam layer may be heated at 225° F. for three minutes so as to slightly open the slits and harden the lacerated surface.

Alternately, the foam insert layer may be used without any slitting of an exterior surface to increase the amount of rebound from the protective equipment. Typically, a plain, uniform foam insert layer of polyethylene will have a 50% greater rebounding effect than deer hair stuffed pads. If the same polyethylene foam layer includes slits in the shape of squares of ½ inch by ½ inch dimension, formed by cuts ½ inch deep, the rebounding effect will be 50% of a deer hair stuffed pad. As the size of the area between the cut surfaces increases, the amount of rebounding from the protective equipment as controlled by the foam insert layer also increases.

Tests were performed on protective equipment with the only variable being changing of the foam insert layer. The protective equipment was set on a dummy and positioned to extend vertically from the floor. A hockey puck projector, available under the tradename BONI, was used to control the speed of a fired hockey puck. The tests were conducted at a room temperature of 72° F. with the puck also being at room temperature. Twenty eight shots for each test were taken with the average rebound distance calculated and shown in the chart below.

Over the course of the test, approximately 216 shots were taken against the foam insert layer without affecting the strength, durability, or rebound characteristics of the layer. In a similar test using deer hair pads, the pads progressively broke down and had to be replaced prior to completion of 216 shots.

POLYETHYLENE FOAM INSERT LAYER 2.8 (pcf) (1" thick)

| MPH | Area of Cut (Depth: ¼") | Rebound Distance (ft.) |
|---|---|---|
| 50 | ½" × ½" | 4 |
| | ¾" × ¾" | 8 |
| | FULL | 10 |
| 75 | ½" × ½" | 10 |
| | ¾" × ¾" | 12 |
| | FULL | 15 |
| 100 | ½" × ½" | 15 |
| | ¾" × ¾" | 15 |
| | FULL | 20 |

Accordingly, it is an object of the present invention to provide protective equipment having a controlled amount of rebound of an object from the equipment.

It is another object of the present invention to provide protective equipment having a cosmetic component layer and a soft, rear backing pad layer with a foam insert layer located between the cosmetic layer and the backing pad layer.

It is yet another object of the present invention to provide protective equipment having a cosmetic component layer and a soft, rear backing pad layer with a foam insert layer located between the cosmetic layer and the backing pad layer with either the cosmetic layer or the backing pad layer having a pocket for receipt of the foam insert layer so as to be able to change the foam insert layer for control of the amount of rebound off of the protective equipment.

It is still yet another object of the present invention to provide two component protective equipment of a cosmetic layer and a backing pad layer with a foam insert layer being integral with one of the cosmetic layer or backing pad layer.

These and other objects of the invention, as well as many of the intended advantages thereof, will become more readily apparent when reference is made to the following description taken in conjunction with the accompanying drawings.

BRIEF DESCRIPTION OF THE DRAWINGS

FIG. 7 is an illustration of a foam layer insert having 1 inch by 1 inch squares formed by lacerations.

FIG. 8 is a sectional view taken along line 8—8 of FIG. 7.

FIG. 9 is a sectional view taken along line 9—9 of FIG. 7.

FIG. 10 illustrates a foam layer insert having ½ inch by ½ inch squares formed by lacerations.

FIG. 11 is an illustration of a foam layer insert having a smooth exterior surface.

FIG. 12 illustrates a single component backing pad layer and foam insert layer.

FIG. 13 illustrates the cosmetic component layer with a pocket for receipt of a foam insert layer.

DETAILED DESCRIPTION OF THE DRAWINGS

Figure 1:
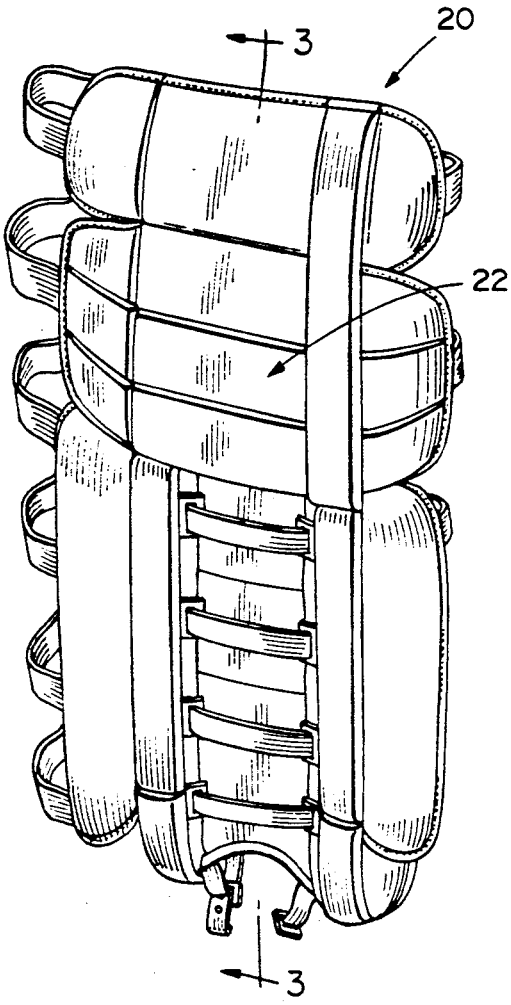
FIG. 1 is a perspective view of the invention showing a cosmetic component layer.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2:
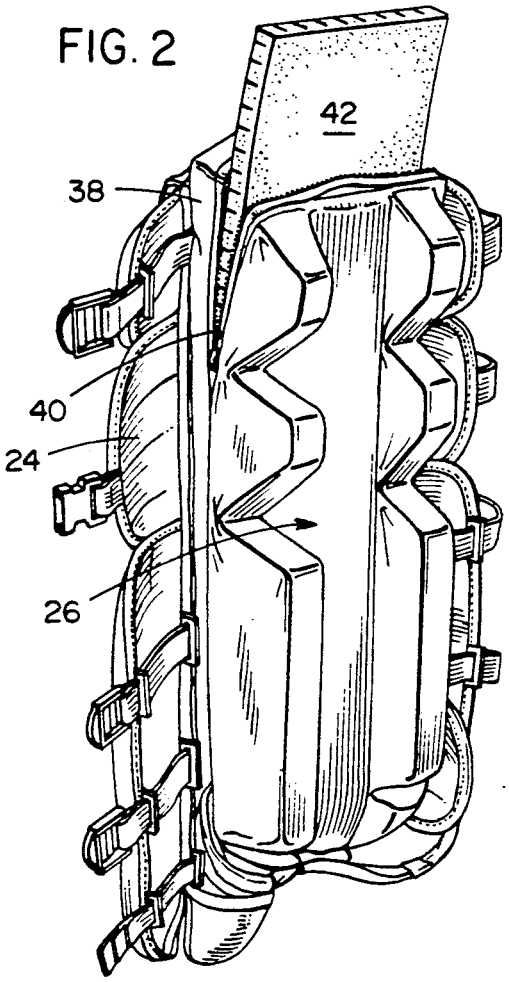
FIG. 2 is a rear perspective view of FIG. 1 showing a soft backing pad layer secured to the cosmetic component layer with a foam insert layer protruding from a zippered opening in a pocket formed on the backing pad layer.
Figure 5:
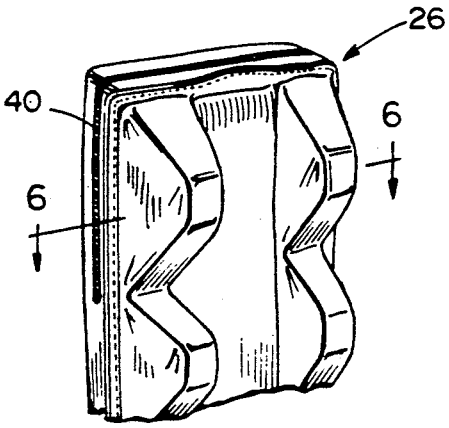
FIG. 5 is a view of the backing pad layer of FIG. 5 with the pocket zippered.

With reference to the drawings, in general, and to FIGS. 1 through 6, in particular, a hockey goalie pad embodying the teachings of the subject invention is generally designated as 20. With reference to its orientation in FIG. 1, the hockey goalie pad includes a cosmetic component layer 22 which is padded and adapted to include color coordination of a particular team designation. Secured to an interior surface 24 of the cosmetic component layer is a soft backing pad layer 26, as shown in FIG. 2, which is only for the comfort of the wearer.

Soft backing pad layer 26 includes a fabric cover 28 which surrounds side protection pads 30 and a fabric cover 32 which surrounds central protective pad 36. It is also possible that pads 30 and 36 are formed of a single soft back pad surrounded by a single fabric cover as is partially shown in FIG. 12.

More importantly, on a side of the backing pad layer 26, facing the interior surface 24 of the cosmetic component layer 22, is a fabric cover 38 having a zippered opening 40 for receipt of a foam insert layer 42. The foam insert layer 42 is removably mounted in the pocket defined by the fabric 38 and zippered opening 40 for retaining the foam insert layer between the cosmetic component layer 22 and the backing pad layer 26. By this arrangement, the foam insert layer is sandwiched between the cosmetic component layer 22 and the back pad layer 26. It is important that a particular side of the foam insert layer face the cosmetic component layer so as to control the amount of rebound of an object from the cosmetic component layer.

Figure 4:
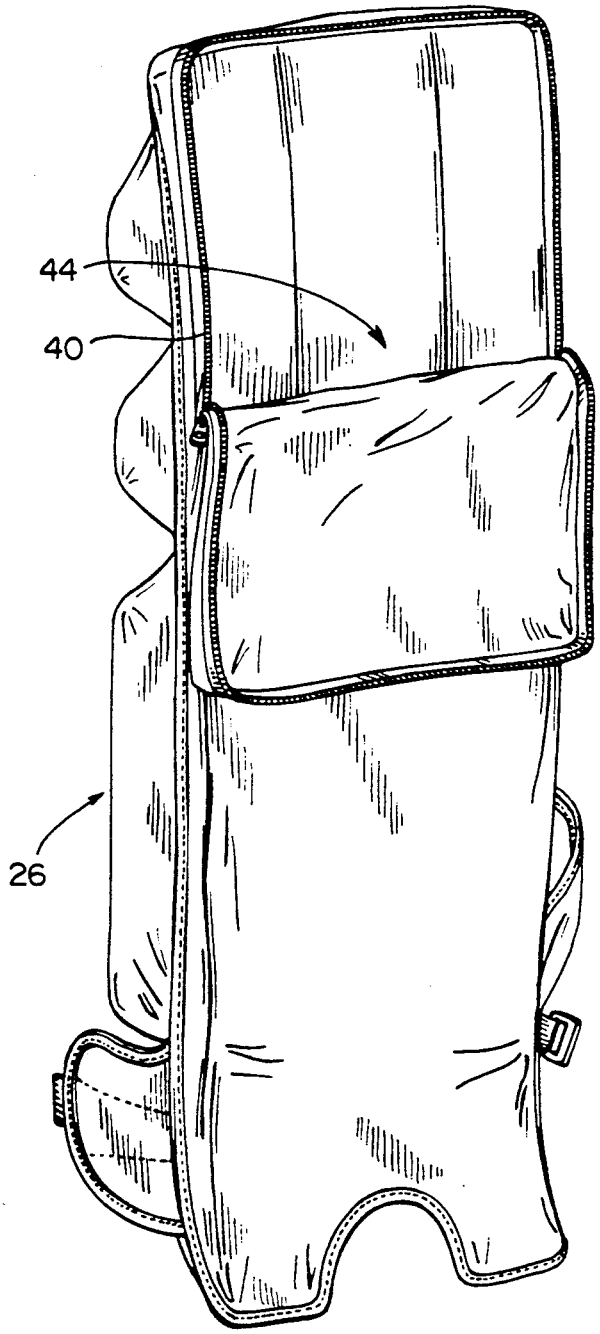
FIG. 4 illustrates the soft backing pad layer with the unzippered pocket formed on the pad layer for receipt of a foam insert layer.

In FIG. 4, the pocket 44 for receipt of the foam insert layer 42 is shown as being formed on a surface of the backing pad layer which is secured to the interior surface 24 of the cosmetic component layer by straps and buckles as is already known.

Figure 6:
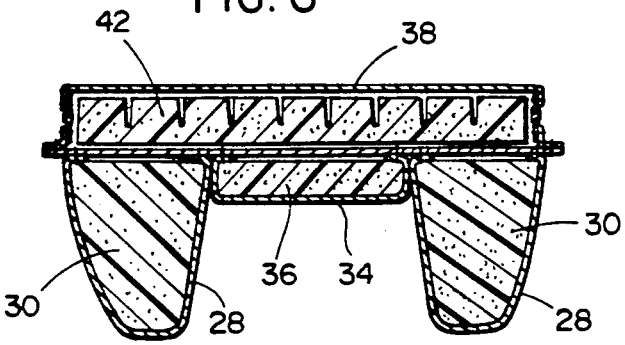
FIG. 6 is a sectional view taken along line 6—6 of FIG. 5.
Figure 3:
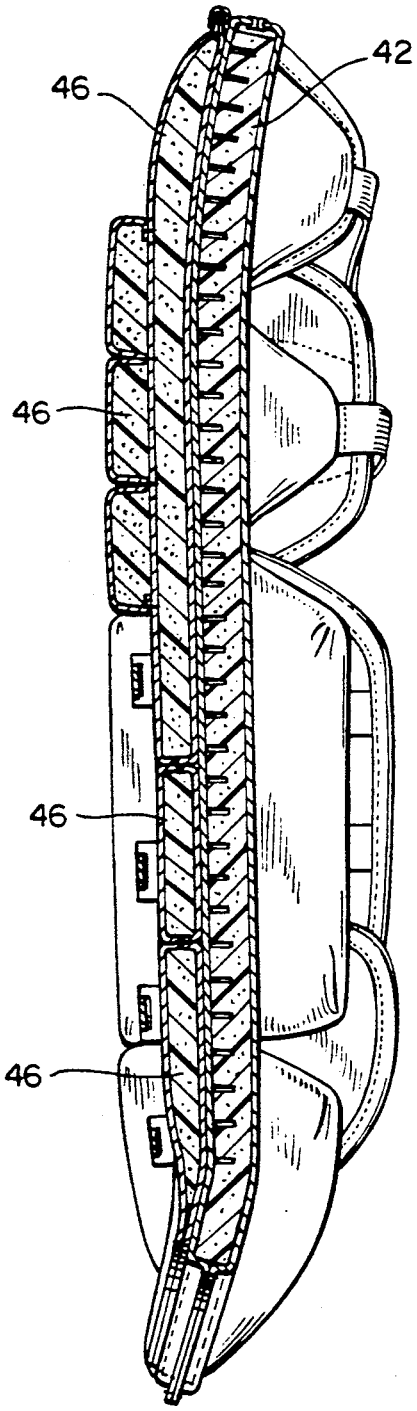
FIG. 3 is a side, partial sectional view taken along line 3—3 of FIG. 1.

The pads 30 and pad 36 of the backing pad 26 in FIG. 6 and the single component backing pad layer in FIG. 12 are made of a soft closed-cell foam.

In the cosmetic component layer 22, the pads 46 are made of one inch thick foam having a density of 4.4 pcf.

In an alternate embodiment, as shown in FIG. 12, the soft backing pad 48 is formed of a single piece of closed-cell foam. In FIG. 12, the foam insert layer 42 is secured by gluing, heating or some other acceptable means to the soft backing pad layer 48 so as to make a single backing pad for the cosmetic component layer, which is encased in a fabric sack 50. The sack 50 including the foam insert layer 42 and the backing pad 48, designated as 52, is removably mounted on the interior surface 24 of the cosmetic component layer for changing the amount of rebound of a projectile from the cosmetic component layer.

Alternately, a pocket 54 may be formed in a sack 56, secured to the interior surface 24 of the cosmetic component layer 22, so as to receive a foam insert layer 42, as shown in FIG. 13. foam insert layer 42 would then be removably secured within the pocket 54 of the sack 56 and easily removed and changed with a different foam insert layer to control the amount of rebound off the cosmetic component layer.

In all the different arrangements shown in FIGS. 2 through 6, 12 and 13, the essential characteristic is that the foam insert layer is sandwiched between a cosmetic component layer and a soft backing pad layer. By removal of the foam insert layer, having a specific characteristic for controlling the amount of rebound of an object off the cosmetic component layer, and substituting a different foam insert layer between the cosmetic component layer and the soft backing pad layer, the amount of rebound off the cosmetic component layer is controlled to a predetermined amount. This also includes positioning the lacerated side of the foam insert layer, when there are lacerations present, against the cosmetic component layer.

In FIGS. 7 through 9, some examples of foam insert layers 42 are shown. In FIG. 11, the foam insert layer shown is approximately one inch thick and made of LD polyethylene foam available under the tradename PLASTAZOTE, which is a cross-linked closed-cell foam of 4.4 pcf density. The surface 58, which is placed against the interior surface 24 of the cosmetic component layer, is smooth and continuous to provide a predetermined amount of rebound by projectiles hitting the cosmetic component layer.

In FIG. 7, the same one inch thick foam as shown in FIG. 11 includes perpendicular lacerations across the surface 58, which extend to a depth of ½ inch. A plurality of one inch by one inch squares 60 is thereby made across the face of the foam layer insert.

The squares 60 may be made by several different techniques. One technique for thermoplastic foam involves cutting the surface 58 of the foam layer insert with a room temperature blade. The foam layer insert is then heated to a temperature of 225° F. for three minutes causing the surface 58 to harden and shrink. The individual squares 60 are thereby isolated by gaps 62 which are formed between the squares 60. The gaps 62 taper inwardly from the surface 58 towards the center of the foam layer insert.

In an alternate embodiment for forming the squares 60 of thermoplastic foam, a hot wire is used to cut the foam layer insert into the desired size and geometry of the surface layer 58. The hot wire causes slits to be formed and simultaneously hardens the cut surface. A third method of forming thermoplastic or thermoset foam to the desired shape and configuration is by molding the foam layer insert with the desired configuration present in the mold for producing an end product having the desired shape and configuration. A fourth method would use lacerations with blades of a thermoset foam without reheating. All of the above techniques could be performed with laminated foam of two or more layers of different thickness and density.

In another embodiment, the single piece insert layer may be made of three layers of closed-cell foam of the same or different densities. Two homogeneous exterior layers may be ¼ inch thick with a central ½ inch thick layer having a honeycomb pattern. The honeycomb pattern may be made by slitting or extruding. Dependent upon the size of the openings of the honeycomb pattern, the amount of rebound could be controlled.

In FIG. 10, a different shape for the squares formed by perpendicular cuts in the surface 58 is made. The squares 63 are of a ½ inch by ½ inch dimension and also include gaps.

Based on extensive testing, it has been determined that there is a direct relationship between the increase in the size of the shape of the geometric pattern produced on the foam layer insert, and an increase in the amount of rebound off of a cosmetic component layer placed in front of the foam insert layer, which is backed by a soft backing pad layer. Therefore, the greater number of cuts and cavities in the foam insert layer, the less the amount of rebound.

Having described the invention, many modifications thereto will become apparent to those skilled in the art to which it pertains without deviation from the scope and the spirit of the invention as defined by the scope of the appended claims.

We claim:

1. In combination, a changeable rebound characteristic hockey goalie pad for protecting a hockey player and a plurality of inserts for the hockey goalie pad, said changeable rebound characteristic hockey goalie pad and said plurality of inserts comprising:

a cosmetic component layer forming an outermost portion of the hockey goalie pad, a backing pad layer forming an innermost portion of the hockey goalie pad, a closed-cell foam layer of a predetermined thickness having two sides and being removably sandwiched between said cosmetic component layer and said backing pad layer for controlling a rebound characteristic of a hockey puck striking against said cosmetic component layer, one side of said closed-cell foam layer facing said cosmetic component layer and the other side of said closed-cell foam layer facing said backing pad layer, said one side having a predetermined geometric grid pattern of lacerations extending from said one side towards a center of said closed-cell foam layer and extending substantially completely over said one side with a predetermined depth of the lacerations of the geometric pattern to produce a desired amount of rebound of a hockey puck striking said cosmetic component layer, and said closed-cell foam layer being replaceable with another closed-cell foam layer having a different geometric grid pattern of lacerations extending from said one side towards a center of said closed-cell foam layer and extending substantially completely over said one side to form a plurality of land members between the lacerations with an increase in surface of the land members resulting in an increase in distance of rebound and when the depth of the lacerations of the geometric grid pattern is increased, a decrease in the distance of rebound occurs to change by a predetermined amount, as compared to the original closed-cell foam layer, the rebound of a hockey puck striking said cosmetic component layer, and means for gaining access to said closed-cell foam layer by a hockey player prior to, during and after an ongoing hockey game to remove said closed-cell foam layer from between said cosmetic component layer and said backing pad layer for replacing said closed-cell foam layer with said another closed-cell foam layer during the ongoing game and securing said another closed-cell foam layer between said cosmetic component layer and said backing pad layer to change by a predetermined amount during the ongoing game, as compared to the original closed-cell foam layer, the rebound of a hockey puck striking said cosmetic component layer so that during an ongoing hockey game said another closed-cell foam layer is substituted for said closed-cell foam layer to change the rebound characteristic of the hockey puck and thereby confuse players of an opposing team as to the amount and direction of expected rebound when the substitution occurs.

2. The combination as claimed in claim 1, wherein said foam layer has a density of 1 to 10 pcf.

3. The combination as claimed in claim 2, wherein said foam layer has a density of 2 to 4 pcf.

4. The combination as claimed in claim 3, wherein said closed-cell foam layer is removably mounted on said backing pad layer.

5. The combination as claimed in claim 3, wherein said closed-cell foam layer is removably mounted on said cosmetic component layer.

6. The combination as claimed in claim 1, wherein said foam layer is approximately one inch thick.

7. The combination as claimed in claim 6, wherein one of said predetermined characteristics of said side of said foam layer is having a smooth surface forming said one side.

8. The combination as claimed in claim 1, wherein said lacerations extend to a depth of approximately ½ inch.

9. The combination as claimed in claim 8, wherein said lacerations form squares measuring ½ inch by ½ inch.

10. The combination as claimed in claim 8, wherein said lacerations form squares measuring 1 inch by 1 inch.

11. The combination as claimed in claim 8, wherein said lacerations form squares measuring ¾ inch by ¾ inch.

12. The combination as claimed in claim 1, wherein said closed-cell foam layer is removably mounted on said backing pad layer.

13. The combination as claimed in claim 1, wherein said closed-cell foam layer is removably mounted on said cosmetic component layer.

14. In combination, a hockey goalie pad and a plurality of inserts for the hockey goalie pad to change the amount of rebound of a hockey puck from the hockey goalie pad prior to, during and after an ongoing hockey game, each of said inserts comprising:

a closed-cell foam layer having a density of 1 to 10 pcf adapted to be mounted between a cosmetic component layer and a backing pad layer of the hockey pad, said closed-cell foam layer having a side surface to be placed against the cosmetic component layer to control the amount of rebound of a hockey puck striking the cosmetic component layer, each of said plurality of inserts as compared to another of said plurality of inserts having a different geometric grid pattern of lacerations extending from said side surface towards a center of said insert and extending substantially completely over said one side surface to form a plurality of land members between the lacerations with an increase in surface of the land members resulting in an increase in distance of rebound and when the depth of the lacerations of the geometric grid pattern is increased, a decrease in the distance of rebound occurs in a hockey puck striking the cosmetic component layer when said side surface of said one insert is placed against the cosmetic component layer to change the amount of rebound of a hockey puck striking the cosmetic component layer as compared to said one insert when said side surface of said another insert is placed against the cosmetic component layer so that during an ongoing hockey game said another insert is substituted for said one insert to change the rebound characteristic of the hockey puck and thereby confuse players of an opposing team as to the amount and direction of expected rebound when the substitution occurs.

15. The combination as claimed in claim 14, wherein said foam layer has a density of 2 to 4 pcf.

16. At least one of a plurality of inserts for sports equipment as claimed in claim 14, wherein said foam layer is one inch thick.

17. The combination as claimed in claim 16, wherein said side surface is smooth.

18. At least one of a plurality of inserts for sports equipment as claimed in claim 14, wherein the greater a surface area between adjacent lacerations, the greater the amount of rebound of an object from the cosmetic component layer.

19. The combination as claimed in claim 18, wherein said lacerations extend to a depth of approximately ½ inch.

20. The combination as claimed in claim 19, wherein said lacerations form squares measuring ½ inch by ½ inch.

21. The combination as claimed in claim 19, wherein said lacerations form squares measuring 1 inch by 1 inch.

22. The combination as claimed in claim 19, wherein said lacerations form squares measuring ¾ inch by ¾ inch.

23. The combination as claimed in claim 14, wherein said foam insert layer is selected from the group of polyethylene, vinyl nitrile, ethylene vinyl acetate, and styrene-butadiene rubber.

* * * * *